US007405712B2

(12) United States Patent
Kimura et al.

(10) Patent No.: US 7,405,712 B2
(45) Date of Patent: Jul. 29, 2008

(54) METHOD FOR DRIVING ELECTRO-OPTICAL DEVICE, ELECTRO-OPTICAL DEVICE AND ELECTRONIC EQUIPMENT

(75) Inventors: Mutsumi Kimura, Kyotanabe (JP); Hiroyuki Hara, Chino (JP)

(73) Assignee: Seiko Epson Corporation, Tokyo (JP)

( * ) Notice: Subject to any disclaimer, the term of this patent is extended or adjusted under 35 U.S.C. 154(b) by 656 days.

(21) Appl. No.: 10/959,999

(22) Filed: Oct. 8, 2004

(65) Prior Publication Data

US 2005/0104816 A1 May 19, 2005

(30) Foreign Application Priority Data

Oct. 28, 2003 (JP) ..... 2003-367501

(51) Int. Cl.
*G09G 3/30* (2006.01)

(52) U.S. Cl. ..... 345/76; 315/169.3

(58) Field of Classification Search ..... 345/76–82, 345/87–102

See application file for complete search history.

(56) References Cited

U.S. PATENT DOCUMENTS

| | | | | |
|---|---|---|---|---|
| 6,229,506 | B1 | 5/2001 | Dawson et al. | |
| 6,859,193 | B1 | 2/2005 | Yumoto | |
| 6,954,190 | B2 | 10/2005 | Komiya | |
| 7,113,154 | B1 | 9/2006 | Inukai | |
| 7,193,591 | B2 | 3/2007 | Yumoto | |
| 7,205,966 | B2 * | 4/2007 | Numao | 345/76 |
| 2002/0135309 | A1 | 9/2002 | Okuda | |
| 2004/0207615 | A1 | 10/2004 | Yumoto | |
| 2005/0190177 | A1 | 9/2005 | Yumoto | |

FOREIGN PATENT DOCUMENTS

| | | | |
|---|---|---|---|
| EP | 1 282 103 | A2 | 1/2002 |
| EP | 1 202 242 | A2 | 5/2002 |
| JP | A-2002-236469 | | 8/2002 |
| JP | 2002-351357 | | 12/2002 |
| JP | A 2003-022049 | | 1/2003 |
| JP | A 2003-022050 | | 1/2003 |
| KR | 2001-52029 | A | 6/2001 |
| KR | 2002-32570 | A | 5/2002 |
| WO | WO 98/48403 | A1 | 10/1998 |
| WO | WO 01/06484 | A1 | 1/2001 |
| WO | WO02-05254 | | 1/2002 |

* cited by examiner

*Primary Examiner*—Duc Q Dinh
(74) *Attorney, Agent, or Firm*—Oliff & Berridge, PLC

(57) ABSTRACT

Aspects of the invention can provide a method for driving an electro-optical device, an electro-optical device and electronic equipment that can solve the insufficient supply of the data current and current fluctuation. In the driving method, a data current can be applied to a plurality of pixels provided to a display panel unit with same value through the data line regardless of grayscale data. Upon supply of the data current, in the pixel, a transistor selected in reproduction can be turned on such that a drive current corresponding to the data current output from a driving transistor is supplied to an organic EL element, thereby emitting light. A light-off signal can be supplied to the pixel at predetermined timing such that the organic EL element emits light only in the light-emitting period computed based on the grayscale data. The pixel to which a constant data current can be supplied emits light at a luminance corresponding to the grayscale data by changing the light-emitting period corresponding to the grayscale data.

12 Claims, 5 Drawing Sheets

METHOD FOR DRIVING ELECTRO-OPTICAL DEVICE, ELECTRO-OPTICAL DEVICE AND ELECTRONIC EQUIPMENT

BACKGROUND OF THE INVENTION

1. Field of Invention

Aspects of the invention can relate to a method for driving electro-optical device, an electro-optical device and electronic equipment.

2. Description of Related Art

Related art organic electro luminescence display devices (organic EL display device) can be referred to as electro-optical devices, and can include an electro-optical element made of an organic EL material. Related art electro-optical device can also have excellent characteristics of self-luminous, high luminance, high-angle-of-field, low profile, quick response, and low power consumption. Further, such devices can be made to be smaller and lighter with a peripheral driving circuit using a polysilicon TFT (Thin Film Transistor).

Incidentally, this kind of organic EL display device has a luminance variation between pixels. Thus, various kind of driving methods including a current program method are proposed. See, for example, U.S. Pat. No. 6,229,506 B1.

SUMMARY OF THE INVENTION

The related art driving method in the U.S. Pat. No. 6,229,506 B1 or the like can compensate a characteristic variation of the TFT and the organic EL element because a saturated region of the TFT is utilized. However, a grayscale shift can occur due to the change of supply current to the organic EL element caused by fluctuation in the operating point of a driving transistor (TFT) and an incomplete writing (insufficient supply) of a data current in a low grayscale region.

In sum, the insufficient supply of the data current in the low grayscale region is caused by wiring resistance and wiring capacitance in a data line supplying a program data current to a pixel circuit. It takes a time to store (write) the program data current in the pixel circuit depending on the wiring resistance and wiring capacitance of the data line. Moreover, if moving images or the like are displayed, the organic EL display device needs to supply the program current to each pixel circuit within a predetermined time. Accordingly, the smaller of the program data current is, namely more in the low grayscale region, the more difficult to complete the writing (supply) of the program data current to a capacitance element in the pixel circuit within the predetermined time. Thus, this insufficient supply results in the luminance shift.

The change of supply current to the organic EL element due to the fluctuation of the operation point of the driving transistor (TFT) is caused by the difference of the load characteristic of a transistor for TFT drive in a programming period in which the program data current is supplied, and a light-emitting period in which a drive current is supplied to the organic EL element.

The current path in which a current flows via the driving transistor when the program data current is supplied (programming period) is different from the current path in which a current flows via the driving transistor when light is emitted. Thus, the load characteristic differs in the both periods.

FIG. 7 shows the drain voltage-drain current characteristic at different gate voltages of the driving transistor. L1 shows the load curve when the program data current is supplied. L2 shows the load curve when light is emitted. Therefore, if the data current is supplied at the operating points Pa1, Pa2, Pa3, Pa4 and so forth on the load curve L1 and then the light-emitting operation proceeds, the load curve of the driving transistor is shifted from the load curve L1 to the load curve L2. For example, the operating point Pa1 is shifted to the operating point Pb1. Likewise, the operating point Pa3 is shifted to the operating point Pb3. As shown in FIG. 7, the drain voltage-current characteristic curve has a certain slope in the saturated region, which is not completely saturated. Thus, the respective drain current is changed if the operating points Pa1, Pa2, Pa3, Pa 4 and so forth are shifted to the corresponding operation points Pb1, Pb2, Pb3, Pb4 and so forth respectively. Since the current change differs in every operating point, namely in every data current value, the luminance in response to the data current cannot be achieved, resulting in the luminance shift.

Aspects of the invention can provide a method for driving an electro-optical device, an electro-optical device and electronic equipment that can solve the insufficient supply of the data current and current fluctuation.

An exemplary method of driving an electro-optical device of a first aspect of the invention can include a step of supplying a data current to a pixel including a storage capacitor, a driving transistor, and an electro-optical element, the data current being a predetermined constant value regardless of input grayscale data to the pixel, a step of driving the electro-optical element by a drive current supplied from the driving transistor corresponding to the data current, and a step of adjusting a period for driving the electro-optical element based on the grayscale data. According to the first aspect of the invention, even if the grayscale data is the grayscale data of a low grayscale, the same data current as that for the grayscale data of a high grayscale is supplied. Thus, since the data current is not changed corresponding to the grayscale data, for example, the insufficient supply of the data current at the low grayscale is solved when the data current is large. In addition, the shift of an operation point of the driving transistor from when the data current is supplied to when the electro-optical element is driven is always maintained at constant regardless of the grayscale data. As a result, the change of the drive current that differs in every data current value is solved, the change of the drive current being caused by the operation point shift.

In the method of driving an electro-optical device, it can be preferable that the data current being the predetermined constant value has a current value of the data current corresponding to a value of a highest level of grayscale among the grayscale data. Accordingly, the data current is set to the data current being the largest current value corresponding to the value of the highest level of grayscale among the grayscale data. Therefore, even if the grayscale data input is the grayscale data of a low grayscale, the insufficient supply of the data current is solved because the data current is a large value.

In the method of driving an electro-optical device, it can be preferable that the step of adjusting the period for driving the electro-optical element is to adjust timing for supplying a voltage signal to the storage capacitor so as to turn off the driving transistor. Accordingly, since the storage capacitor holds the voltage signal, the driving transistor is kept in off condition, namely the electro-optical element is kept in the light-off condition, until the next data current is supplied.

An exemplary electro-optical device of a second aspect of the invention can include a pixel including a storage capacitor, a driving transistor, and an electro-optical element, the electro-optical element being driven by a drive current supplied from the driving transistor corresponding to a value of a data current, a data current producing circuit producing the data current being a predetermined constant value regardless of input grayscale data; a drive stop signal producing circuit producing a drive stop signal in order to stop a drive of the electro-optical element, and a control circuit controlling to supply the data current to the pixel from the data current producing circuit, computing a period for driving the electro-optical element by a drive current from the driving transistor, and controlling to supply the drive stop signal to the pixel from the drive stop signal producing circuit based on the driving period.

According to the second aspect of the invention, the control circuit can control to supply the constant data current to the pixel regardless of the input grayscale data, namely even if the grayscale data is the grayscale data of a low grayscale or a high grayscale. In addition, the control circuit computes a period for driving the electro-optical element corresponding to the grayscale data and controls to supply the drive stop signal to the pixel based on the driving period.

In the electro-optical device, it can be preferable that the data current produced by the data current producing circuit has a current value of the data current corresponding to a value of a highest level of grayscale among the grayscale data. Accordingly, the data current is set to the data current being the largest current value corresponding to the value of the highest level of grayscale among the grayscale data. Therefore, even if the grayscale data input is the grayscale data of a low grayscale, the insufficient supply of the data current is solved because the data current has a large value.

In the electro-optical device, it can be preferable that the drive stop signal produced by the drive stop signal producing circuit is a voltage signal supplied to the storage capacitor so as to turn off the driving transistor. Accordingly, since the storage capacitor holds the voltage signal, the driving transistor is kept in off condition, namely the electro-optical element is kept in the light-off condition, until the next data current is supplied.

In the electro-optical device, it can be preferable that the electro-optical element is an organic electro luminescence element. Accordingly, the organic electro luminescence element emits light with a constant current value. The light-emitting period is adjusted such that the organic electro luminescence element emits light at the luminance corresponding to the grayscale data.

Electro equipment of a third exemplary embodiment can include the above-mentioned electro-optical device. Accordingly, the display that is excellent in display quality and able to solve the insufficient supply of the data current and current fluctuation can be achieved.

BRIEF DESCRIPTION OF THE DRAWINGS

The invention will be described with reference to the accompanying drawings, wherein like numerals reference like elements, and wherein.

DETAILED DESCRIPTION OF PREFERRED EMBODIMENTS

Figure 1:
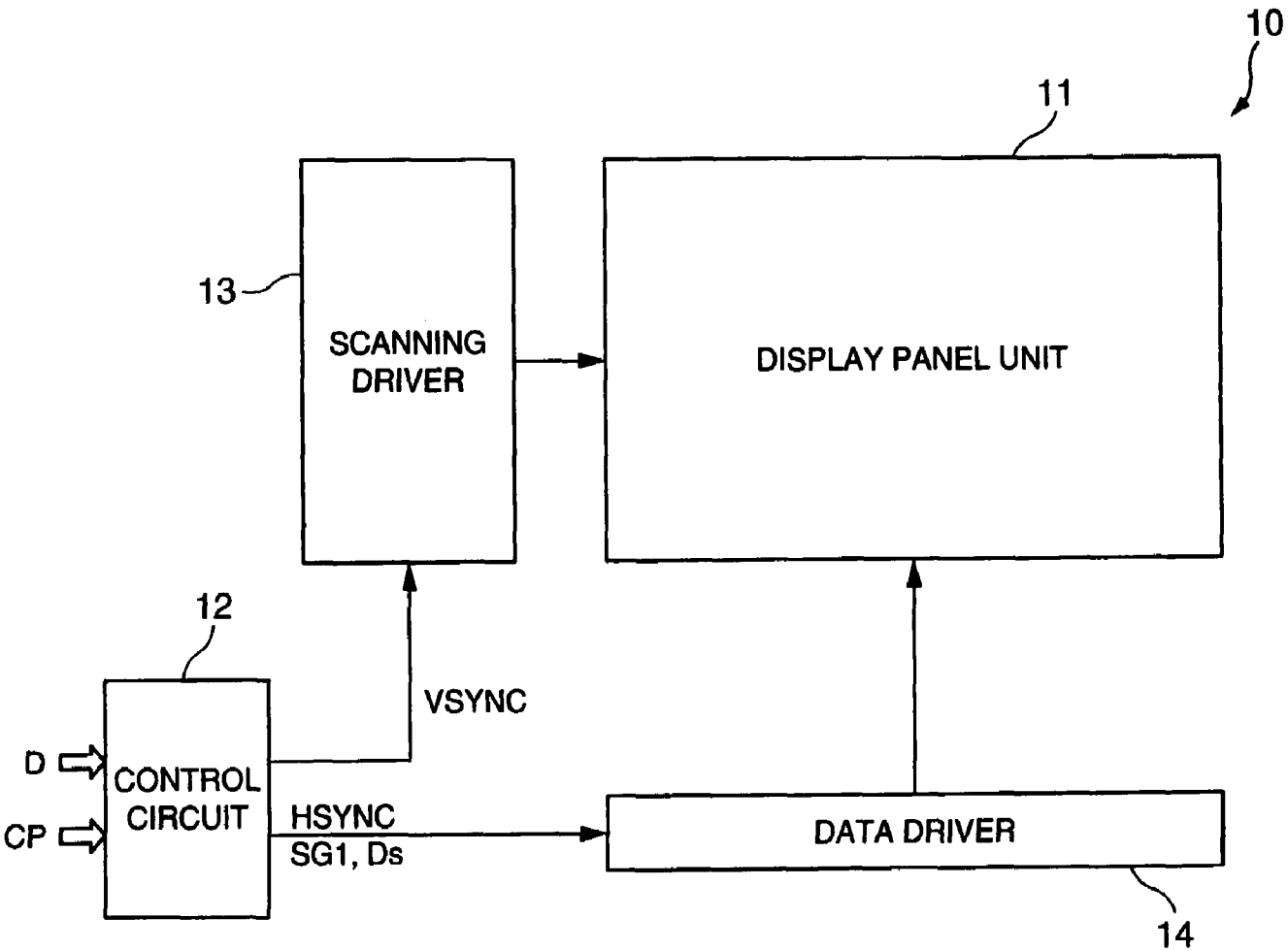
FIG. 1 is a block circuit diagram illustrating electrical construction of an organic electro luminescence display device of a first exemplary embodiment of the invention.

A first exemplary embodiment of the invention will be explained below with reference to FIGS. 1 through 5. FIG. 1 is an exemplary block circuit diagram illustrating electrical construction of an organic electro luminescence (Electro Luminescence; hereinafter referred as EL) display device that is an example of an electro-optical device embodying the invention. In FIG. 1, an organic EL display device 10 can include a display panel unit 11, a control circuit 12, a scanning driver 13 and a data driver 14.

The control circuit 12, the scanning driver 13 and the data driver 14 of the organic EL display device 10 may be constructed with discrete electronic components. For example, the control circuit 12, the scanning driver 13 and the data driver 14 may be constructed with a one-chip semiconductor integrated circuit device. In addition, the control circuit 12, the scanning driver 13 and the data driver 14 may be constructed as the electronic component in which all of them or a part of them are integrated. For example, the control circuit 12, the scanning driver 13 and the data driver 14 may be integrally constructed in the display panel unit 11. All of the control circuit 12, the scanning driver 13 and the data driver 14 or a part of them may be constructed with a programmable IC chip. The function may be realized in software in program written in the IC chip.

Figure 2:
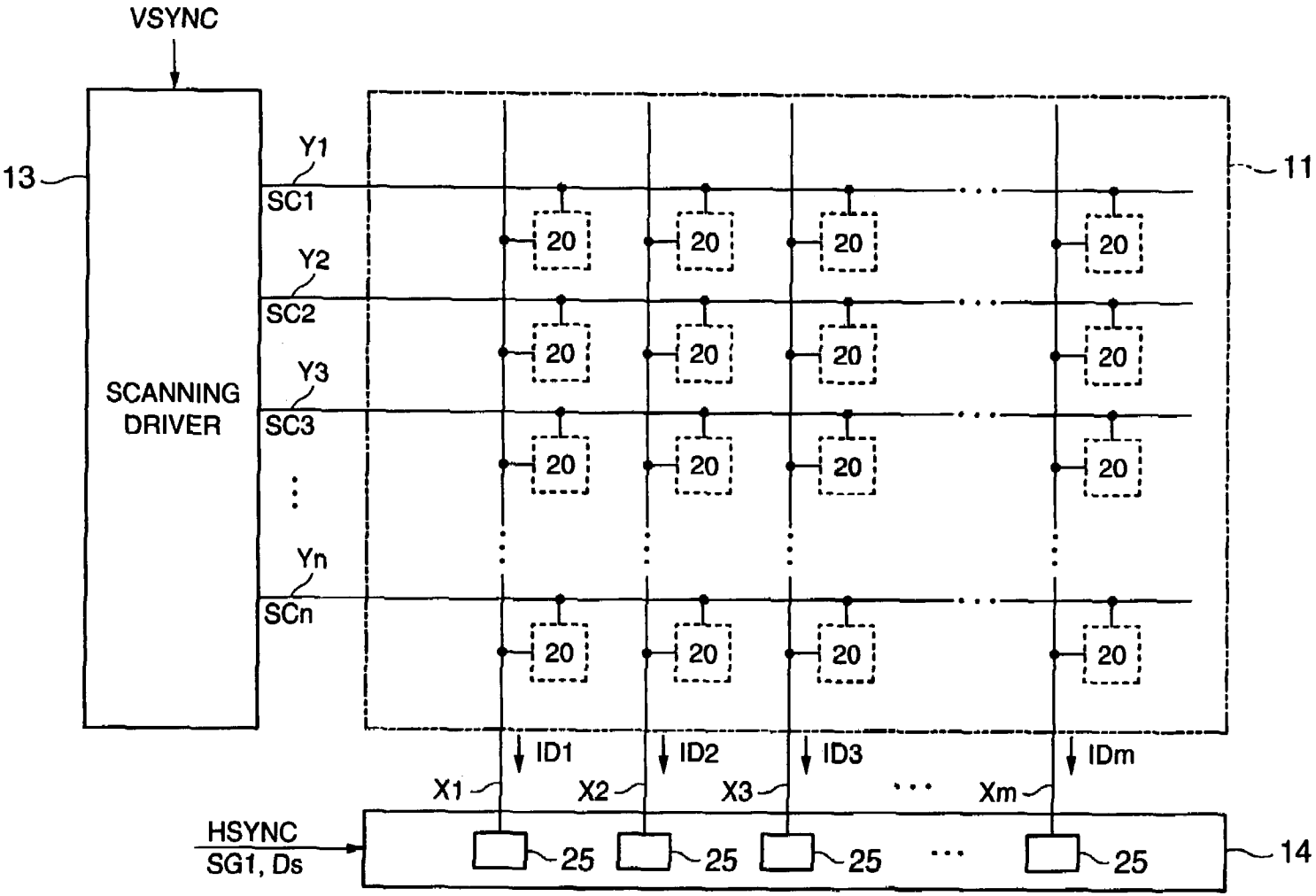
FIG. 2 is a block circuit diagram illustrating circuit construction of a display panel unit.

As shown in FIG. 2, in the display panel unit 11, a plurality of data lines X1 to Xm (m is natural number) extending along in the column direction and a plurality of scanning lines Y1 to Yn (n is natural number) extending along in the row direction are wired. In addition, the display panel 11 includes a plurality of pixels 20 arranged at intersections between the plurality of data lines X1 to Xm and the plurality of scanning lines Y1 to Yn. Thus, each pixel 20 is arranged between the plurality of data lines X1 to Xm extending along in the column direction and the plurality of scanning lines Y1 to Yn extending along in the row direction so as to be electrically connected. As a result, the pixels 20 are arranged in a matrix. Each pixel 20 includes an organic EL element 21 (refer to FIG. 3) made of an organic material in a luminescence layer.

Figure 3:
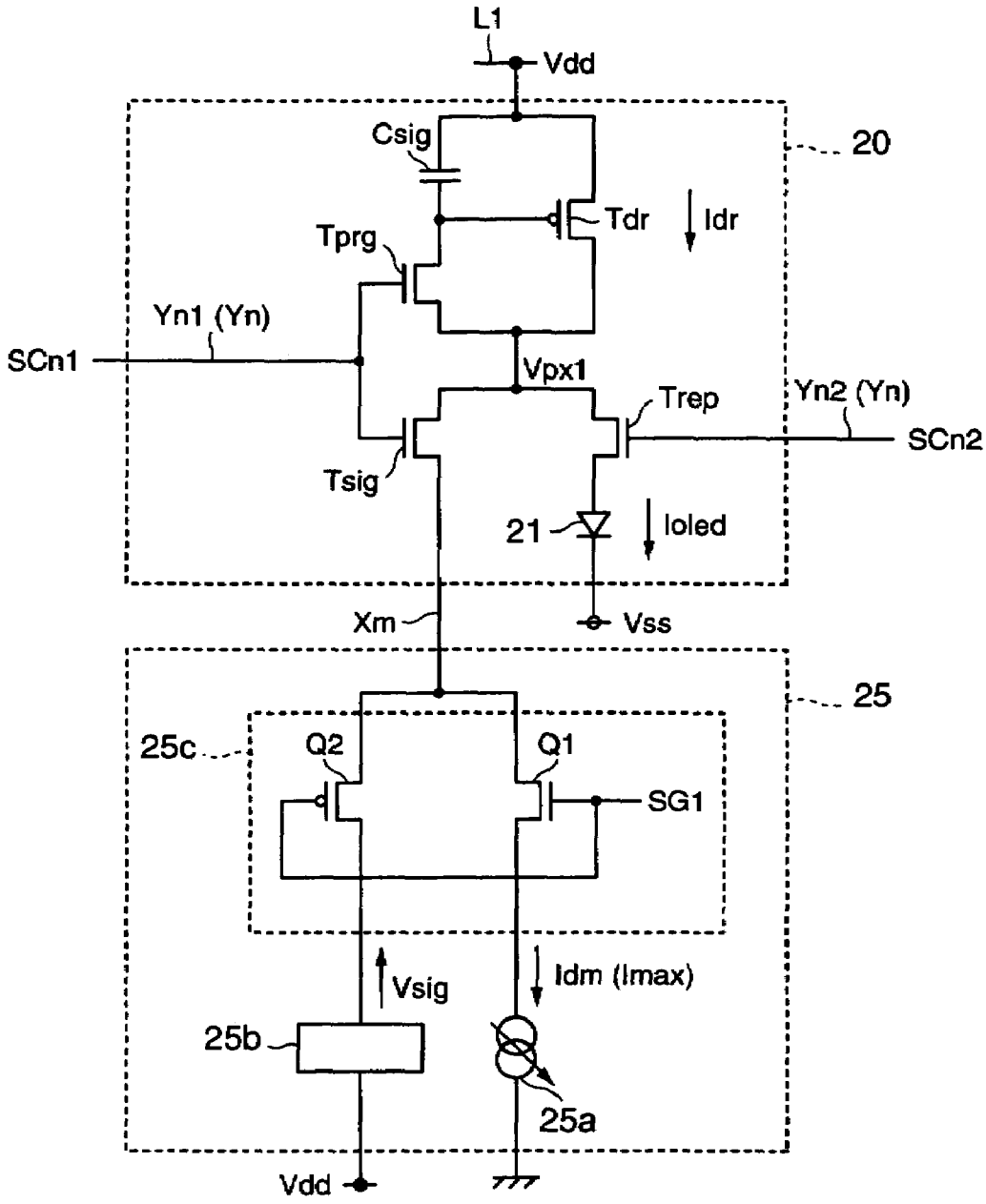
FIG. 3 is a circuit diagram of a pixel.

FIG. 3 is an exemplary circuit diagram illustrating the internal construction of the pixel 20. In FIG. 3, the pixel 20 includes a driving transistor Tdr, a transistor for programming Tprg, a transistor selected in programming Tsig, a transistor selected in reproduction Trep and a storage capacitor Csig. The driving transistor Tdr is made of a P-channel TFT. The transistor for programming Tprg, the transistor selected in programming Tsig and the transistor selected in reproduction Trep are made of an N-channel TFT.

The drain of the driving transistor Tdr is connected to the anode of the organic EL element 21 through the transistor selected in reproduction Trep. The cathode of the organic EL element 21 is grounded. Also, the drain of the driving transistor Tdr is connected to the data line Xm through the transistor selected in programming Tsig. In addition, the source of the driving transistor Tdr is connected to a power supply line L1. A driving voltage Vdd is supplied to the power supply line L1 so as to drive the organic EL element 21. Further, the gate of the driving transistor Tdr is connected to a first electrode of the storage capacitor Csig. A second electrode of the storage capacitor Csig is connected to the power supply line L1. The transistor for programming Tprg is connected between the gate and drain of the driving transistor Tdr.

The gate of the transistor selected in programming Tsig and the transistor for programming Tprg are connected to a first scanning line Yn1 included in a scanning line Yn. The transistor selected in programming Tsig and the transistor for programming Tprg are turned on in response to a first scanning signal SCn1 of a H level from the first scanning line Yn1, and are turned off in response to the first scanning signal SCn1 of a L level. The gate of the transistor selected in reproduction Trep is connected to a second scanning line Yn2 included in the scanning line Yn. The transistor selected in reproduction Trep is turned on in response to a second scanning signal SCn2 of the H level from the second scanning line Yn2, and are turned off in response to the second scanning signal SCn2 of the L level.

The organic EL element 21 emits light at the luminance corresponding to the value of a drive current Idr (supply current Ioled) supplied through the driving transistor Tdr.

Figure 4:
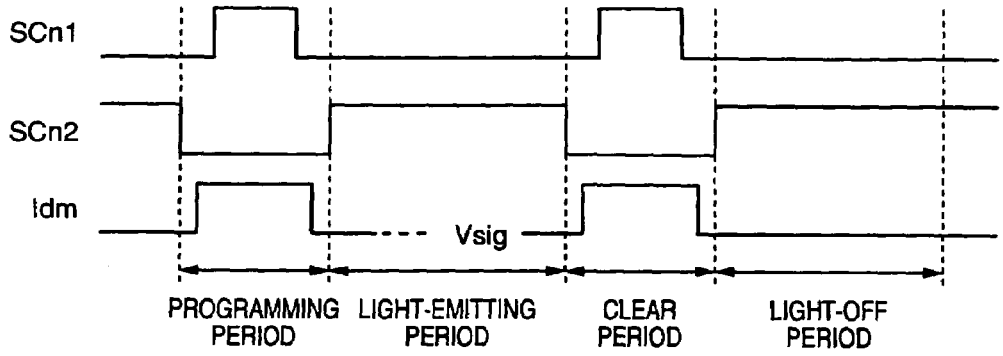
FIG. 4 is a time chart explaining a series operation including a programming period, a luminescence period, a clear period and a light-off period of the pixel.

Next, The operation of the pixel 20 will be briefly explained. FIG. 4 is a time chart explaining a series of operation including the programming period, the light-emitting period, a clear period and a light-off period of the pixel 20.

If the first scanning signal SCn1 of the H level is output, the transistor for programming Tprg and the transistor selected in programming Tsig are turned on. At the same time, the second scanning signal SCn2 of the L level is output such that the transistor selected in reproduction Trep is turned off. As a result, a data current Idm is supplied to the data line Xm. Since the transistor for programming Tprg is turned on, the driving transistor Tdr is connected in the diode connection. Accordingly, the data current Idm flows in the path from the driving transistor Tdr to the data line Xm through the transistor selected in programming Tsig. At the same time, an electronic charge corresponding to the gate potential of the driving transistor Tdr is stored in the storage capacitor Csig.

Subsequently, the first scanning signal SCn1 is turned to the L level. The second scanning signal SCn2 is turned to the H level. Thus, the transistor for programming Tprg and the transistor selected in programming Tsig are turned off. The transistor selected in reproduction Trep is turned on. Since the storage of the electronic charge in the storage capacitor Csig is unchanged, the gate potential of the driving transistor Tdr is maintained at the voltage at which the data current Idm flowed. Thus, the drive current Idr (supply current Ioled) corresponding to the gate voltage flows between the source and the drain of the driving transistor Tdr.

Specifically, the supply current Ioled flows in the path from the driving transistor Tdr to the organic EL element 21 through the transistor selected in reproduction Trep. Accordingly, the organic EL element 21 emits light at the luminance corresponding to the supply current Ioled. Since the current flow path is different between in the programming period and in the light-emitting period, the load characteristic of the driving transistor Tdr is changed, thereby resulting in the change of the operation point. Therefore, as above-mentioned, the fluctuation ratio of the supply current Ioled can differ depending on the value of the data current Idm.

If the second scanning signal SCn2 is turned to the L level after a predetermined time is passed from the time at which the organic EL element 21 emits light, the transistor selected in reproduction Trep is turned off. Thus, at this point, no supply current Iold is supplied to the organic EL element 21 so as to be light-off. Subsequently, if the first scanning signal SCn1 is turned to the H level, the transistor for programming Tprg and the transistor selected in programming Tsig are turned on. At the same time, a light-off signal Vsig (=Vdd) is supplied to the data line Xm to be a drive stop signal. Also, at the same time, the light-off signal Vsig (=Vdd) is supplied to the first electrode of the storage capacitor Csig. As a result, the driving transistor Tdr is turned off because the gate and drain of the driving transistor Tdr have the same potential.

Subsequently, the first scanning signal SCn1 is turned to the L level. The second scanning signal SCn2 is turned to the H level. Thus, the transistor for programming Tprg and the transistor selected in programming Tsig are turned off. The transistor selected in reproduction Trep is turned on. At the same time, since the potential of the first electrode of the storage capacitor Csig is maintained at the same potential of that of the source of the driving transistor Tdr, the driving transistor Tdr is maintained to be off. Thus, the organic EL element 21 continues to be kept in light-off until next programming period.

Therefore, the luminance of the organic EL element 21 can be controlled with the data current Idm of a constant value by changing the light-emitting period (changing the light-off period) while always keeping the data current Idm at the constant value. In sum, the grayscale control can be performed without taking the fluctuation ratio of the supply current Ioled into consideration, the fluctuation ratio of the supply current Ioled varying depending on the data current Idm, which is accompanied by the operating point change caused by the load characteristic change of the driving transistor Tdr.

Accordingly, in this exemplary embodiment, a data driver 14 described below can output the data current Idm at the constant value and the light-off signal Vsig (=Vdd) regardless of grayscale data. In addition, a scanning driver 13 described below also can generate the first scanning signal SCn1 and the second scanning signal SCn2 both of which set the clear period and the light-off period based on the grayscale data.

A control circuit 12 receives an image signal (grayscale data) D and a clock pulse CP for displaying an image on the display panel unit 11 from an outside device (not shown). In this embodiment, each image signal (grayscale data) D for each pixel 20 is corrected for the largest value of grayscale data. The control circuit 12 outputs the largest value of grayscale data to the test driver 14 as a reference grayscale data Ds for each pixel 20. Here, if the grayscale data is "0" to "63" grayscales, the reference grayscale data is the grayscale data D of "63" grayscales. Accordingly, the data driver 14 outputs the data current Imax based on the reference grayscale data Ds (grayscale data of 63 grayscales) to the data lines X1 to Xm such that the organic EL element of each pixel 20 emits light the most brightly regardless of the grayscale data from the outside device. Consequently, the control circuit 12 adjusts the light-emitting period such that the luminance of the organic EL element 21 is corresponding to the image signal (grayscale data) D even though the organic EL element 21 emits light based on the reference grayscale data Ds.

Figure 5:
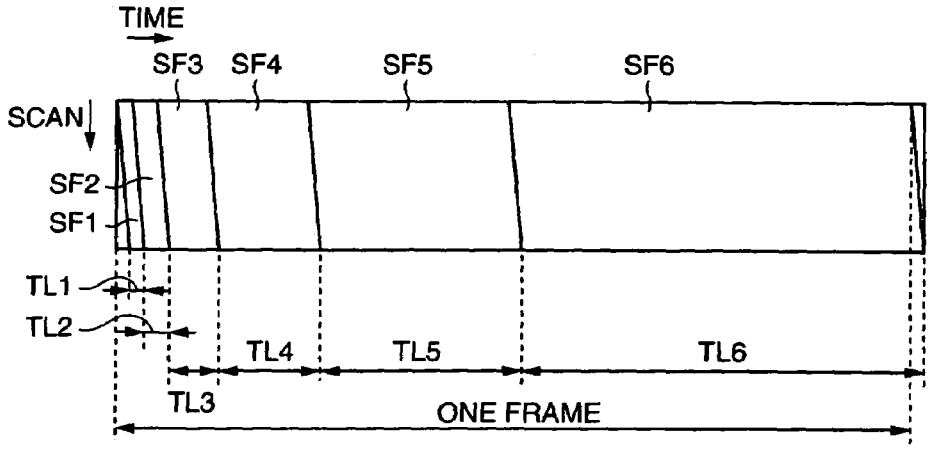
FIG. 5 is a diagram explaining construction in which one frame of a first embodiment of the present invention is divided into a first sub-frame to a sixth sub-frame.

Specifically, in the control circuit 12, one frame is divided into a plurality of sub-frames. Control data whether the light-emitting or the light-off in each sub-frame is made for each pixel 20 based on the image signal D. In this exemplary embodiment, as shown in FIG. 5, one frame is divided into 6 sub-frames, a first sub-frame SF1 to a sixth sub-frame SF6, in order to display gray scale in 64 grayscales. A period TL1 to a period TL6 are corresponding to the first sub-frame SF1 to the sixth sub-frame SF6. The periods TL1 to TL6 are set at a ratio of:

TL1:TL2:TL3:TL4:TL5:TL6=1:2:4:8:16:32

If the grayscale data D is "63" grayscales, all from the first sub-frame SF1 to the sixth sub-frame SF6 are selected so as to emit light for the light-emitting period T (=TL1+TL2+TL3+TL4+TL5+TL6). As a result, the light can be emitted at the luminance corresponding to the grayscale data D of "63" grayscales. If the grayscale data D is "31" grayscales, from the first sub-frame SF1 to the fifth sub-frame SF5 are selected so as to emit light for the light-emitting period T (=TL1+TL2+TL3+TL4+TL5). As a result, the pixel 20 can emit the light at the luminance corresponding to the grayscale data D of "31" grayscales apparently. If the grayscale data D is "12" grayscales, the third sub-frame SF3 and the fourth sub-frame SF4 are selected so as to emit light for the light-emitting period T (=TL3+TL4). As a result, the pixel 20 can emit the light at the luminance corresponding to the grayscale data D of "12" grayscales. In sum, the data current Imax being the largest current value corresponding to the "63" grayscales is supplied to the data lines X1 to Xm. By changing the light-emitting period T depending on the grayscale data D, the pixel 20 emits the light at the luminance corresponding to the grayscale data D.

For this reason, the control circuit 12 makes the data for controlling the sub-frame whether to be the light-emitting or not light-emitting (light-off) in one frame for each pixel 20 based on the grayscale data D for the pixel 20. The control circuit 12 outputs a control signal SG1 to the data driver 14, the control signal SG1 determining whether the sub-frame is the period of the light-emitting or the light-off when the scanning lines Y1 to Yn are scanned for every sub-frames SF1 to SF6 based on the control data obtained for the pixel 20. The control circuit 12 outputs the control signal SG1 of the H level for the light-emitting period of the sub-frame, and the control signal SG1 of the L level for the light-off period of the sub-frame in each of the sub-frames SF1 to SF6.

The control circuit 12 generates and outputs a vertical synchronizing signal VSYNC to the scanning driver 13, the vertical synchronizing signal VSYNC determining the timing to sequentially select each of the scanning lines Y1 to Yn in each of the first sub-frame SF1 to the sixth sub-frame SF6 in one frame based on the clock pulse CP. In addition, the control circuit 12 generates and outputs a horizontal synchronizing signal HSYNC to the data driver 14, the horizontal synchronizing signal HSYNC determining the timing to output the reference grayscale data and the control signal SG1 corresponding to each of the data lines X1 to Xm based on the clock pulse CP.

The scanning driver 13 can be connected to each of the scanning lines Y1 to Yn. The scanning driver 13 arbitrarily selects one of the scanning lines Y1 to Yn so as to select the group of the pixels 20 for one row based on the vertical synchronizing signal VSYNC in each of the sub-frames SF1 to SF6 in one frame. Each of the scanning lines Y1 to Yn includes each of the first scanning lines Y11 to Yn1 and each of the second scanning lines Y12 to Yn2. The scanning driver 13 supplies the first scanning signals SC11 to SCn1 to the transistor for programming Tprg and the transistor selected in programming Tsig of the pixel 20 respectively through the first scanning lines Y11 to Yn1 in each of the sub-frames SF1 to SF6. Also, the scanning driver 13 supplies the second scanning signals SC12 to SCn2 to the transistor selected in reproduction Trep of the pixel 20 respectively through the second scanning lines Y12 to Yn2 in each of the sub-frames SF1 to SF6.

The data driver 14 receives the horizontal synchronizing signal HSYNC, the reference grayscale data Ds and the control signal SG 1 from the control circuit 12. In the data driver 14, a single line driving circuit 25 is provided to each of the data lines X1 to Xm. The reference grayscale data Ds corresponding to the single line driving circuit 25 is input to each single line driving circuit 25 in order in synchronization with the horizontal synchronizing signal HSYNC. As shown in FIG. 3, each single line driving circuit 25 includes a data current producing circuit 25*a*, a light-off signal producing circuit 25*b* as a drive stop signal producing circuit, and a switching circuit 25*c*. The data current producing circuit 25*a* produces a data current based on the reference data Ds output from the control circuit 12. Each data current producing circuit 25*a* includes a digital-analogue converting circuit. For example, 6 bits grayscale data are digital-analog converted to the analogue current of 0 to 63 grayscales, producing the data currents Id1 to Idm correspondingly. In this embodiment, all of each single line driving circuit 25 receives the reference grayscale data Ds being the same value from the control circuit 12. Specifically, the reference grayscale data Ds, which has the largest value (the largest grayscale among the grayscale data D), is output respectively to the data current producing circuit 25*a* of each single line driving circuit 25 from the control circuit 12. Thus, each single line driving circuit 25 produces the data currents Id1 to Idm (=Imax) all of which have the same largest value of the current.

In this exemplary embodiment, the light-off signal producing circuit 25*b*, to which the driving voltage Vdd supplied to the power supply line L1 is applied, outputs the driving voltage Vdd as the light-off signal Vsig. The light-off signal Vsig corresponds to the drive stop signal or the voltage signal in the claims.

The switching circuit 25*c* can include a first switch Q1 and a second switch Q2. The first switch Q1 is connected between the data line Xm and the data current producing circuit 25*a*. The first switch Q1 is constructed with an N-channel FET in this embodiment. The control signal SG is input to the gate of the first switch Q1 from the control circuit 12. If the control signal SG1 of the H level is input, the first switch Q1 of each single line driving circuit 25 is turned on so as to output the data currents Id1 to Idm (=Imax) to the data lines X1 to Xm correspondingly. Contrary, if the control signal SG1 of the L level is input, the first switch Q1 of each single line driving circuit 25 is turned off so as to stop the supply of the data currents Id1 to Idm (=Imax) to the data lines X1 to Xm correspondingly.

The second switch Q2 is connected between the data line Xm and the light-off signal producing circuit 25*b*. The second switch Q2 is constructed with a P-channel FET in this embodiment. The control signal SG is input to the gate of the second switch Q2 from the control circuit 12. If the control signal SG1 of the L level is input, the second switch Q2 of each single line driving circuit 25 is turned on so as to output the light-off signal Vsig from the light-off signal producing circuit 25*b* to the data lines X1 to Xm correspondingly. Contrary, if the control signal SG1 of the H level is input, the second switch Q2 of each single line driving circuit 25 is turned off so as to stop the supply of the light-off signal Vsig to the data lines X1 to Xm correspondingly.

Next, the operation of the organic EL display device 10 constructed as above-mentioned will be explained.

The control circuit 12 receives one frame of the image signal D. The control circuit 12 makes the data for controlling the sub-frame in which whether or not light is emitted in the first sub-frame SF1 to the sixth sub-frame SF6 with respect to each pixel 20 based on one frame of the image signal D.

Next, the control circuit 12 outputs the vertical synchronizing signal VSYNC to the scanning driver 13, and the horizontal synchronizing signal HSYNC to the data driver 14. The scanning driver 13 sequentially produces the first scanning signals SC11 to SCn1 and the second scanning signals SC12 to SCn2 for the first sub-frame SF1 based on the vertical synchronizing signal VSYNC so as to select each of the scanning lines Y1 to Yn in order.

The data driver 14 receives the reference grayscale data Ds and the control signal SG1 every time when each of the scanning lines Y1 to Yn is selected, the control signal SG1 determining whether or not light is emitted in the period TL1 in the first sub-frame SF1 with respect to each pixel 20 on the selected scanning line. The data current producing circuit 25*a* of each single line driving circuit 25 produces the data current Imax being the same current value based on the reference grayscale data Ds. In addition, either the control signal SG1 of the H level for the light-emitting of the pixel 20 or the control signal SG1 of the L level for the light-off of the pixel 20 is input to the switching circuit 25*c* of each single line driving circuit 25. The data current Imax is supplied to the data line for the pixel 20 in which light is emitted. The light-off signal Vsig is applied to the data line for the pixel 20 in which light is not emitted.

If the data current Imax is supplied to the pixel 20 in which light is emitted and the light-off signal Vsig is supplied to the pixel 20 in which light is not emitted, the scanning driver 13 causes the transistor selected in reproduction Trep to be turned on based on the second scanning signal. The organic EL element 21 to which the data current Imax has been supplied emits light by the drive current Idr (supply current Ioled) supplied because the transistor selected in reproduction Trep turns on. The organic EL element 21 of the pixel 20 to which the light-off signal Vsig has been supplied emits no light. Because the driving transistor Tdr turns off. Therefore, no current Ioled is supplied. This condition continues to be kept until the selection in the next second sub-frame SF2.

If the scanning driver 13 proceeds to the selection of the next scanning line, the same manner as described above is carried out to each pixel on the newly selected line. Either the data current Imax or the light-off signal Vsig is supplied to each pixel 20 from the data driver 14 with respect to each control signal SG1. Each pixel 20 emits light or puts off light corresponding to the data current Imax or the light-off signal Vsig.

When the supply of either the data current Imax or the light-off signal Vsig to each pixel 20 on the last scanning line of the first sub-frame SF1 is completed, the scanning driver 13 sequentially produces the first scanning signals SC11 to SCn2 and the second scanning signals SC12 to SCn2 for the second sub-frame so as to select each of the scanning lines Y1 to Yn in order. The control circuit 12 outputs the control signal SG1 and the reference grayscale data Ds for each pixel on the selected scanning line in the second sub-frame SF2 as the same manner as that in the above-mentioned. The data driver 14 supplies the data current Imax or the light-off signal Vsig to each pixel 20 on the selected scanning line based on the control signal SG1 for each pixel 20 every time when the scanning line is selected. Each pixel 20 on the selected scanning line emits light or puts off light corresponding to the data current Imax or the light-off signal Vsig supplied as the same manner as that in the above-mentioned.

Subsequently, the same operation is repeated for the third sub-frame SF3 to the sixth sub-frame SF6 such that the image of one frame is displayed with each pixel 20 in the display unit 11. Upon completion of the image display operation of one frame, the image display operation for the next one frame is carried out in the same manner.

Therefore, for example, in the case where the grayscale data of "63" grayscales is supplied to the pixel 20, the pixel 20 emits light in all of the first sub-frame SF1 to the sixth sub-frame SF6 with the data current Imax supplied. The light-emitting period T is: T=TL1+TL2+TL3+TL4+TL5+TL6. If the grayscale data D of "15" grayscales is supplied to a pixel 20, the pixel 20 emits light in the first sub-frame SF1 to the fourth sub-frame SF4, and puts off light in the fifth sub-frame SF5 and the sixth sub-frame SF6 with the data current Imax supplied. The light-emitting period T is: T=TL1+TL2+TL3+TL4. If the grayscale data D of "3" grayscales is supplied to a pixel 20, the pixel 20 emits light in the first sub-frame SF1 and the second sub-frame SF2 with the data current Imax supplied, and puts off light in the third sub-frame SF3 to the sixth sub-frame SF6. The light-emitting period T is: T=TL1+TL2. If the grayscale data D of "6" grayscales is supplied to a pixel 20, the pixel 20 emits light in the second sub-frame SF2 and the third sub-frame SF3 with the data current Imax supplied, and puts off light in the first sub-frame SF1 and the fourth sub-frame SF4 to the sixth sub-frame SF6. The light-emitting period T is: T=TL 2+TL3.

Put simply, the data current Imax being the largest current corresponding to "63" grayscales is supplied to the data lines X1 to Xm. By changing the light-emitting period T corresponding to the grayscale data D, the pixel 20 apparently emits light at the luminance corresponding to the grayscale data D. Thus, since the data current Imax of large current is supplied to the pixel 20 via the data line even though the grayscale data D of the low grayscale, no insufficient supply due to the wiring capacitance or the like of the data line occurs. In addition, since constant data current Imax is always supplied to the pixel 20 over the grayscale data D in range from "0" to "63" grayscales input from the outside device, the shift of the operation point of the driving transistor Tdr from when the data current Imax is supplied to when the organic EL element 21 emits light is always constant regardless of the value of the grayscale data D. As a result, the problem of the luminance shift that can occur by the following manner is solved. That is, the change of the drain current caused by the shift of the operating point differs in each data current value. Since the luminance corresponding to the data current is not obtained, the luminance shift occurs.

According to the above-mentioned exemplary embodiment, the following effect can be achieved. In this exemplary embodiment, the data current Imax being a large value is always applied to the pixel 20 over the grayscale data in range from "0" to "63" grayscales. Therefore, no insufficient supply due to the wiring capacitance or the like of the data line occurs.

Since current Imax being a constant data is always supplied to the pixel 20, the shift of the operation point of the driving transistor Tdr from when the data current Imax is supplied to when the organic EL element 21 emits light is always constant regardless of the value of the grayscale data D. Therefore, the problem of the luminance shift that occurs by the following manner is solved. That is, the change of the drain current caused by the shift of the operating point differs in each data current value. Since the luminance corresponding to the data current is not obtained, the luminance shift occurs.

In this exemplary embodiment, the data current Imax being a constant value is set the largest data current corresponding to the grayscale data D being the highest grayscale ("63" grayscales). Therefore, the incomplete writing can be prevented without fail because the data current Imax being the largest value is supplied even though the grayscale data of a low grayscale.

Next, applications of the organic EL display device 10 explained in the above-mentioned exemplary embodiment as the electric-optical device for electronic equipment will be explained with reference to FIG. 6. The optical EL display device 10 can be applied to various sorts of electronic equipment, such as a mobile type personal computer, a cellular phone, a viewer, a personal digital assistant, such as a game machine, an electronic book, an electronic paper, or the like. In addition, the organic EL display device 10 can be applied to various sorts of electronic equipment such like a video camera, a digital camera, a car navigation, a mobile stereo, an operation panel, a personal computer, a printer, a scanner, a television, a video player, or the like.

Figure 6:
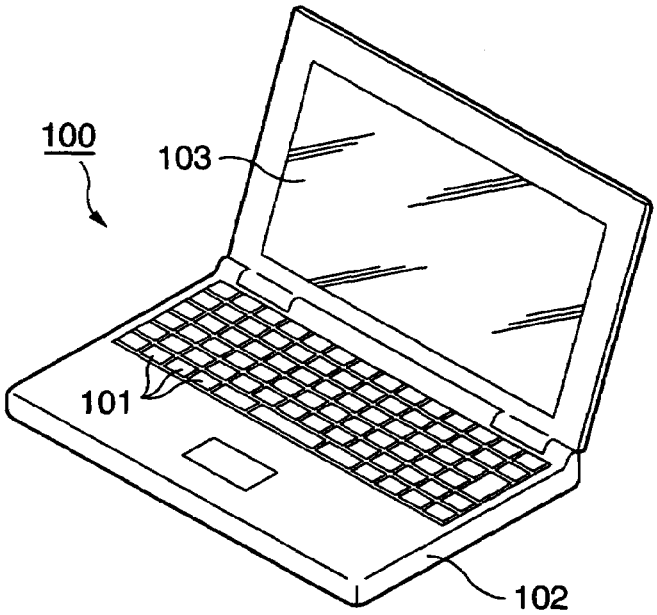
FIG. 6 is a perspective diagram illustrating construction of a mobile type personal computer to explain a second exemplary embodiment of the invention.
Figure 7:
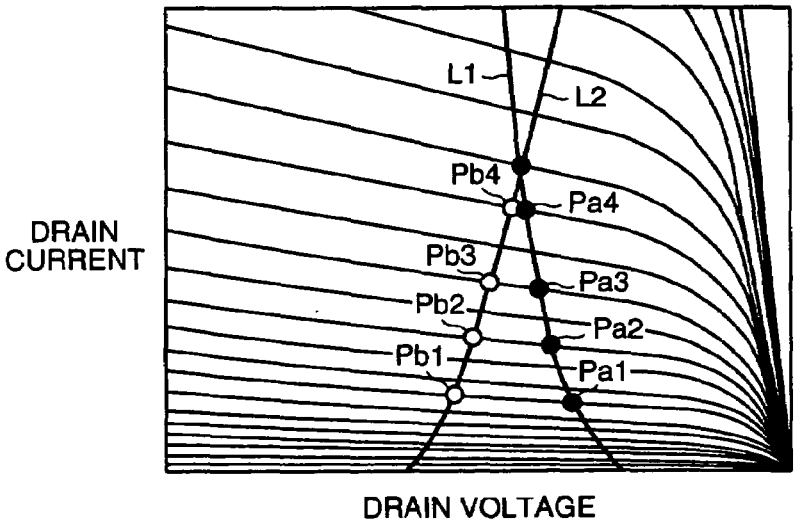
FIG. 7 is a diagram illustrating drain voltage-drain current characteristics at different gate voltages of a driving transistor driving an organic EL element.

FIG. 6 is a perspective view illustrating a construction of a mobile type personal computer. In FIG. 6, the mobile type personal computer 100 includes a body 102 equipped with a keyboard 101 and a display unit 103 using the organic EL display device 10. In this case, the display unit 103 using the organic EL display device 10 demonstrates the same effect as that in the first exemplary embodiment. As a result, the mobile type personal computer 100 can achieve a display of excellent display quality.

The above-mentioned exemplary embodiments may be changed as follows. In the above-mentioned first exemplary embodiment, one frame is divided into the first sub-frame SF1 to the sixth sub-frame SF6. The light-emitting period T corresponding to the grayscale data D is selected from the first sub-frame SF1 to the sixth sub-frame SF6. The light is emitted only in the period of the sub-frame selected.

However, this may be changed as follows. A selection line can be provided to each pixel 20 in order to clear it independently. After passing the light-emitting period, each pixel 20 is independently selected through the selection line such that the light-off signal Vsig is supplied to the pixel 20 to be light-off. As a result, each pixel 20 may emit light at the luminance corresponding to the grayscale data D.

In the above-mentioned first exemplary embodiment, the data current Imax is set to the data current corresponding to the highest grayscale data among the grayscale data D. However, it should be understood that the present invention is not limited to this. The point is that the data current that as long as causes no incomplete writing (insufficient supply) can be applicable. For example, the data current corresponding to the middle grayscale among the grayscale data may be set. Also, the data current being a larger value than that of the data current corresponding to the highest grayscale data among the grayscale data D may be set.

In the above-mentioned first exemplary embodiment, the data current Imax corresponding to the highest grayscale data among the grayscale data D is always supplied. This may be changed as follows. For example, if the display device 10 is changed to a low power consumption mode, the data current is changed to the data current being a smaller current value than that of the data current Imax corresponding to the highest grayscale data among the grayscale data D so as to be supplied to each pixel 20 in the low power consumption mode. In this case, when the display device 10 is changed to the low power consumption mode, the control circuit 12 outputs the reference grayscale data Ds for the low power consumption mode to the data current producing circuit 25*a* constructed with a DAC (Digital Analogue Converter) of each single line driving circuit 25.

In the above-mentioned first exemplary embodiment, the data current producing circuit 25*a* is constructed with the DAC. However, a constant current source circuit outputting a constant current value may be included in the data current producing circuit 25*a*. In this case, the circuit scale can be shrunk and a load of the control circuit 12 can be reduced.

While in the above-mentioned exemplary embodiments, the organic EL element 21 is embodied as the electro-optical element, an inorganic electro luminescence element may be embodied. Put simply, the invention may be applied to an inorganic electro luminescence display device including the inorganic electro luminescence element.

In the above-mentioned exemplary embodiments, examples in which the organic EL element is used are explained. However, it should be understood that the invention is not limited to these, a liquid crystal element, a digital micro mirror device (DMD) field emission display (FED), or the like can be applicable.

Additionally, while this invention has been described in conjunction with the specific embodiments thereof, it is evident that many alternatives, modifications, and variations will be apparent to those skilled in the art. Accordingly, preferred embodiments of the invention as set forth herein are intended to be illustrative, not limiting. There are changes that may be made without departing from the spirit and scope of the invention.

What is claimed is:

1. An electro-optical device that includes a plurality of data lines, a plurality of first scanning lines, a plurality of second scanning lines, and a plurality of pixels, each of the plurality of pixels comprising:

a first transistor Tsig;

a second transistor Tprg;

a third transistor Tdr;

a fourth transistor Trep;

a storage capacitor Csig; and an organic EL element, a first electrode of the first transistor Tsig being electrically connected to one of the plurality of data lines, a gate electrode of the first transistor Tsig being electrically connected to one of the plurality of first scanning lines, a first electrode of the second transistor Tprg being electrically connected to a first electrode of the storage capacitor Csig and a gate electrode of the third transistor Tdr, a gate electrode of the second transistor Tprg being electrically connected to the one of the plurality of first scanning lines and the gate electrode of the first transistor Tsig, a first electrode of the third transistor Tdr being electrically connected to a second electrode of the storage capacitor Csig and a Vdd line, a first electrode of the fourth transistor Trep being electrically connected to a second electrode of the first transistor Tsig, a second electrode of the second transistor Tprg, and a second electrode of the third transistor Tdr, a second electrode of the fourth transistor Trep being electrically connected to an electrode of the organic EL element, a gate electrode of the fourth transistor Trep being electrically connected to one of the plurality of second scanning lines, wherein the organic EL element is configured to be turned off such that:

the one of the plurality of second scanning lines provides a signal at low level to turn off the fourth transistor Trep;

the one of the plurality of data lines provides a light-off signal Vsig to the first electrode of the storage capacitor Csig while the fourth transistor Trep is turned off, a voltage of the light-off signal Vsig being equal to that of a signal provided from the Vdd line;

the one of the plurality of first scanning lines provides a signal at high level to turn on the first transistor Tsig and the second transistor Tprg while the fourth transistor Trep is turned off so that the third transistor Tdr is turned off by the light-off signal Vsig and the organic EL element is turned off;

the one of the plurality of first scanning lines provides a signal at low level to turn off the first transistor Tsig and the second transistor Tprg so that the light-off signal Vsig keeps the third transistor Tdr turned off; and the one of the plurality of second scanning lines provides a signal at high level to turn on the fourth transistor Trep after the first transistor Tsig, the second transistor Tprg, and the third transistor Tdr are turned off.

2. An electro-optical device according to claim 1, wherein the organic EL element is configured such that the one of the plurality of second scanning lines provides a signal at low level to turn off the fourth transistor Trep during the whole period of a clear period.

3. An electro-optical device according to claim 1, wherein the organic EL element is configured such that the one of the plurality of second scanning lines provides a signal at high level to turn on the fourth transistor Trep during the whole period of a light-off period.

4. An electro-optical device according to claim 1, wherein the organic EL element is configured such that the one of the plurality of first scanning lines provides a signal at high level to turn on the first transistor Tsig and the second transistor Tprg, between a beginning point of providing a signal at low level to the fourth transistor Trep from the one of the second scanning lines and an end point of providing a signal at low level to the fourth transistor Trep from the one of the second scanning lines.

5. An electro-optical device according to claim 1, wherein the organic EL element is configured such that the one of the plurality of first scanning lines provides a signal at low level to turn off the first transistor Tsig and the second transistor Tprg during the whole period of a light-off period.

6. An electro-optical device according to claim 1, wherein the organic EL element is configured such that a period when the one of the plurality of second scanning lines provides a signal at low level during the clear period is longer than a period when the one of the plurality of first scanning lines provides a signal at high level during the clear period.

7. An electro-optical device according to claim 1, wherein the organic EL element is configured such that total period when the one of the plurality of second scanning lines provides a signal at low level is longer than total period when the one of the plurality of first scanning lines provides a signal at high level.

8. An electro-optical device according to claim 1, wherein the organic EL element is configured to be turned off such that:

the one of the plurality of second scanning lines provides a signal at low level to turn off the fourth transistor Trep;

the one of the plurality of data lines provides a data current Idm to the first electrode of the storage capacitor Csig; and the one of the plurality of first scanning lines provides a signal at high level to turn on the first transistor Tsig and the second transistor Tprg so that the third transistor Tdr is turned on by the data current Idm.

9. An electro-optical device according to claim 1, wherein the organic EL element is configured to be turned on such that:

the one of the plurality of second scanning lines provides a signal at low level to turn off the fourth transistor Trep;

the one of the plurality of data lines provides a data current Idm to the first electrode of the storage capacitor Csig;

the one of the plurality of first scanning lines provides a signal at high level to turn on the first transistor Tsig and the second transistor Tprg so that the third transistor Tdr is turned on by the data current Idm;

the one of the plurality of first scanning lines provides a signal at low level to turn off the first transistor Tsig and the second transistor Tprg so that the data current Idm keeps the third transistor Tdr turned on; and the one of the plurality of second scanning lines provides a signal at high level to turn on the fourth transistor Trep after the first transistor Tsig, the second transistor Tprg, and the third transistor Tdr are turned off.

10. An electro-optical device according to claim 1, further comprising:

a data driver configured to provide a plurality of data signals to the plurality of the data lines, the data driver including a plurality of single line driving circuits, each of the plurality of single line driving circuits having a first switch, a second switch, a data current producing circuit, and a light-off signal producing circuit, each of the plurality of single line driving circuits being electrically connected to a control signal line, wherein a first electrode of the first switch is electrically connected to one of the plurality of data lines, a second electrode of the first switch is electrically connected to the data current producing circuit, a first electrode of the second switch is electrically connected to the one of the plurality of data lines, a second electrode of the second switch is electrically connected to the light-off signal producing circuit, and a gate electrode of the first switch and a gate electrode of the second switch are connected to the control signal line.

11. An Electronic equipment comprising the electro-optical device according to claim 1.

12. A method of driving an electro-optical device, the electro-optical device including a plurality of data lines, a plurality of first scanning lines, a plurality of second scanning lines, and a plurality of pixels, each of the plurality of pixels having a first transistor Tsig, a second transistor Tprg, a third transistor Tdr, a fourth transistor Trep, a storage capacitor Csig, and an organic EL element, a first electrode of the first transistor Tsig being electrically connected to one of the plurality of data lines, a gate electrode of the first transistor Tsig being electrically connected to one of the plurality of first scanning lines, a first electrode of the second transistor Tprg being electrically connected to a first electrode of the storage capacitor Csig and a gate electrode of the third Tdr, a gate electrode of the second transistor Tprg being electrically connected to the one of the plurality of first scanning lines and the gate electrode of the first transistor Tsig, a first electrode of the third Tdr being electrically connected to a second electrode of the storage capacitor Csig and a Vdd line, a first electrode of the fourth transistor Trep being electrically connected to a second electrode of the first transistor Tsig, a second electrode of the second transistor Tprg, and a second electrode of the third transistor Tdr, a second electrode of the fourth transistor Trep being electrically connected to an electrode of the organic EL element, a gate electrode of the fourth transistor Trep being electrically connected to one of the plurality of second scanning lines, the method comprising the following steps:

a first step of providing a signal from the one of the plurality of second scanning lines at low level to turn off the fourth transistor Trep and turn off the organic EL element at a beginning of a clear period;

a second step of providing a light-off signal Vsig from the one of the plurality of data lines, a voltage of the light-off signal Vsig being equal to that of a signal provided from the Vdd line after the first step;

a third step of providing a signal from the one of the plurality of first scanning lines at high level to turn on the first transistor Tsig and the second transistor Tprg after the second step so that the light-off signal Vsig is provided to the first electrode of the storage capacitor Csig and the third transistor Tdr is turned off by the light-off signal Vsig;

a fourth step of providing a signal from the one of the plurality of first scanning lines at low level to turn off the first transistor Tsig and the second transistor Tprg so that the light-off signal Vsig keeps the third transistor Tdr turned off after the third step;

a fifth step of providing a signal from the one of the plurality of second scanning lines at high level to turn on the fourth transistor Trep during the light-off period after the fourth step.

* * * * *